US005725409A

United States Patent [19]

Brunton

[11] Patent Number: 5,725,409

[45] Date of Patent: Mar. 10, 1998

[54] SOUND-EMITTING TOPPLING GAME ELEMENT AND METHOD FOR PLAYING A GAME

[76] Inventor: Scott R. Brunton, 320 S.E. 63rd, Portland, Oreg. 97215

[21] Appl. No.: 386,301

[22] Filed: Feb. 8, 1995

[51] Int. Cl.[6] ..... A63H 5/00

[52] U.S. Cl. ..... 446/2; 84/600; 273/293

[58] Field of Search ..... 273/459, 301, 273/460, 293; 446/2, 325, 397, 404; 84/600

[56] References Cited

U.S. PATENT DOCUMENTS

| | | | |
|---|---|---|---|
| 3,442,045 | 5/1969 | Green | 446/325 X |
| 4,416,247 | 11/1983 | Yoshida | 446/2 X |
| 5,058,894 | 10/1991 | Levinn et al. | 446/397 X |
| 5,221,225 | 6/1993 | Newbold et al. | 446/325 X |
| 5,349,129 | 9/1994 | Wisniewski et al. | 446/397 X |
| 5,405,281 | 4/1995 | Sandor | 446/397 X |

FOREIGN PATENT DOCUMENTS

| | | | |
|---|---|---|---|
| 2249036 | 4/1992 | United Kingdom | 446/397 |

*Primary Examiner*—Paul E. Shapiro

*Attorney, Agent, or Firm*—Keith A. Cushing

[57] ABSTRACT

A game element, a game and a method for playing a game employing a plurality of game elements. The game element comprising a body that is disposed in contact with a playing surface and in an upright position relative to the surface. Incorporated in the body is a sound emission assembly which emits a sound component directly from the body when the body moves from the upright position in a predetermined displacement. The game comprising a plurality of game elements having respective sound components and being disposed uprightly to form an array so that, when toppled in cascade, they emit the respective sound components sequentially along the array to generate one or more sound sequences. The method comprising the steps of: (i) selecting the shape of an array to erect; (ii) selecting a sound sequence to be emitted; (iii) selecting a plurality of game elements according to the sound sequence and the sound components associated with such elements; (iv) erecting the selected array by placing the selected game elements uprightly in adjacent positions; and (v) initiating cascade toppling of the erected array, so that the selected sound sequence is emitted along the array by emission of the respective sound components when each game element topples.

3 Claims, 4 Drawing Sheets

SOUND-EMITTING TOPPLING GAME ELEMENT AND METHOD FOR PLAYING A GAME

BACKGROUND

This invention relates to sound-emitting, toppling game elements and a method for a game that employs a plurality of such elements. More particularly, this invention relates to both a game element that can be toppled and that, when toppled, emits one or more sounds, as well as to a game that employs a plurality of such elements, each element emitting respective one or more sounds and being selectively arrangeable adjacent one another in an array so that, when the elements are subsequently toppled in cascade, sounds are emitted continuously along the array.

Games and toys that employ sound are very popular, having an appeal that spans all ages. Many of these games and toys rely on sound to challenge the user, either as to memory or manual dexterity, or both. An example of a game or toy that challenges as to memory is one that generates notes in a seemingly random series which the user attempts to duplicate from memory. If the user succeeds, the game generates a new, but longer series of notes by which to challenge the user anew, and so on. An example of a game or toy that challenges as to manual dexterity is one that combines a piano, a computer and software, the computer and software generating images and sounds to which the user responds by manually striking piano keys in appropriate sequence and at appropriate times. While the former appeals essentially by using sound to challenge the user, the latter has the additional appeal of teaching the user piano-playing skills.

In addition to sound-employing games and toys, games and toys are known which employ elements arrangeable to topple in cascade. These games and toys also are very popular and appeal to all ages. An example of a toppling game employs a plurality of dominoes that the user stands upright adjacent one another to form a user-selected array. When the array is complete, the user topples the first arrayed domino to set off a chain reaction that topples each of the dominoes in cascade along the array. These toppling games appeal by challenging the user to design and erect arrays of selected size, shape and complexity, as well as by promising the user the opportunity to not only to watch, but also to initiate, the cascade toppling of the dominoes along the array.

While the toppling of dominoes is accompanying by the clicks of each domino striking the next, some known games and toys seek to combine the appeal of toppling with a broad appeal of sound. One such game employs standard domino-like pieces together with an immobile sound center. In use, the pieces are arranged in a user-selected array within which the sound center is interposed: a first piece is placed adjacent one side of the sound center and a second piece is placed adjacent the opposite side of the sound center. Accordingly, when the user starts the pieces to toppling in cascade, the toppling ultimately causes the first piece to fall into the sound center which triggers the center's generation of its sound. At the same time, the sound center, by a mechanical linkage, topples the second piece to reinitiate cascade toppling along the array. See, *Adventure Set with Action Sound Instructions*, Pressman Toy Corporation, New Brunswick, N.J.

While this game combines sound and toppling, it has several shortcomings that diminish the game's appeal. In particular, it has shortcomings associated with use of a sound center. For example, the user's ability to select sounds is limited to those pre-programmed into the sound center. In that regard, the user essentially cannot compose the sounds to be produced by the game. In addition, sound production is centralized at the sound center, rather than being continuous along the array. Moreover, sound associated directly with the pieces is limited to the clicks associated with pieces toppling into one another.

Another game seeking to combine toppling with sound is proposed in Wisniewski et al. U.S. Pat. No. 5,349, 129 ("Wisniewski") entitled ELECTRONIC SOUND GENERATING TOY. Wisniewski uses domino-shaped elements in combination with linear tracks and a sound section. The sound section encloses the toy's sound generating circuitry and an output speaker. The tracks interconnect electromechanically and have regular spaced recesses therealong for receiving respective, user-selectable elements. Each of the recesses includes electronic sensors disposed in predetermined locations. Each of the elements has one or more magnets disposed on a surface that is to be set in the recess. The number and disposition of the magnets is associated with a particular sound, the magnets coupling with some unique combination of sensors. Sounds and sound sequences, such as songs, are produced at the sound section by placing selected elements in adjacent track recesses and, then, causing the elements to topple in cascade. The toppling of an element from its recess is sensed by the coupled sensors so that a signal is generated, the signal being sent along a four-wire bus in the track. The signal is received and decoded by the sound section, triggering the sound section's production of the sound associated with the toppled element's magnets.

Wisniewski's toy is itself subject to several shortcomings, including shortcomings associated with relying on a sound section and interconnecting tracks. For example, the user's ability to select sounds is constrained by the physical limitations on the number and disposition of sensors in a recess, the corresponding number of wires in the tracks, and the ability of the sound section to decode signals in producing sound. In addition, sound production is centralized at the sound section, rather than being distributed along the array. Moreover, sound associated directly with the elements is limited to the clicks associated with elements toppling into one another.

Accordingly, a need exists for a game or toy that is not subject to these and other shortcomings of known games and toys, particularly games and toys seeking to combine the appeal of toppling with the appeal of sound.

SUMMARY

The present invention fulfills the aforementioned need for providing a novel and improved game element and a game that employs a plurality of such elements. In accordance with certain aspects of the invention, a game element for disposition on a surface by a user is provided, the game element comprising a body that is disposed in contact with the surface and in an upright position relative to the surface. Incorporated in the body is a sound emission assembly. The assembly emits a sound component directly from the body when the body moves from the upright position in a predetermined displacement.

In accordance with other aspects of the invention, a game for play by a user on a surface is provided, the game comprising a plurality of game elements having respective sound components. The game elements are disposed uprightly to form an array so that, when toppled in cascade, they emit the respective sound components sequentially along the array to generate one or more sound sequences.

In accordance with still other aspects of the invention, a method for playing a game by a user on a surface is provided, the method comprising the steps of (i) selecting the shape of an array to erect; (ii) selecting a sound sequence to be emitted by a plurality of game elements, each game element having a respective sound component; (iii) selecting a plurality of game elements according to the sound sequence and the sound components associated with such elements; (iv) erecting the selected array by placing the selected game elements uprightly in adjacent positions in accordance with the shape of the array, the sequence of the game elements accommodating emission of the selected sound sequence; and (v) initiating cascade toppling of the erected array, so that the selected sound sequence is emitted along the array by emission of the respective sound components when each game element topples.

As will be readily appreciated from the foregoing, the invention provides a sound-emitting, toppling game element that, when used together with other such elements, is free from the shortcomings of, and provides advantages over, known games and toys. For example: (i) incorporating sound emission assemblies in each game element enables sound production and emission directly from each element and, when the elements are arranged in an array, provides for distributing sound along the array; (ii) properly selecting the shape, dimensions, weight and weight distribution of each game element enables the game elements to be arranged in an array in substantially stable upright positions, and enables cascade toppling of the elements along the array as the elements are not so stable as to unduly inhibit toppling upon contact with another toppling game element; (iii) employing a sound actuation mechanism in each game element provides for enabling sound production and emission when the element topples; (iv) employing marks on each game element to identify the element'sound component or components enables efficient selection of game elements for arrangement in an array, particularly to produce a desired sound sequence; and (v) incorporating lights in the game elements enhances the recreational appeal of the game elements and of the game while also providing diagnostic and operational functions. As a result, the invention includes all of the features and advantages of known games and toys that seek to combine the appeals of toppling and sound, as well as adding new features and advantages and overcoming disadvantages associated with such games and toys.

Accordingly, it is a principle object of the present invention to provide both a novel and improved game element, and a game employing a plurality of such elements.

It is another object of the present invention to provide a game element, and a game employing a plurality of such elements, which combine the appeal of toppling with the appeal of sound, while optimizing the overall appeal to the user.

It is a further object of the present invention to provide a game element, and a game employing a plurality of such elements, wherein each game element emits a sound component upon toppling.

It is yet another object of the present invention to provide a game element, and a game employing a plurality of such elements, wherein the game elements are arranged in an array and sound is emitted directly from the elements along the array.

It is yet a further object of the present invention to provide a game element, and a game employing a plurality of such elements, wherein neither a sound center nor interconnecting circuitry is necessary for the production of sound.

It is still another object of the present invention to provide a game element, and a game employing a plurality of such elements, wherein the game elements are arranged in an array, and each element in the array is user-selectable according to shape, dimensions or sound component or components, or any combination of these or other characteristics.

It is still a further object of the present invention to provide a game element, and a game employing a plurality of such elements, wherein each element is user-selectable according to the emitted tone or tones, or absence of tones, including the tones's pitch, timbre, intensity, duration, timing or other sound characteristics.

It is another object of the present invention to provide a game element, and a game employing a plurality of such elements, wherein each game element has a plurality of sound components and the user can select among the sound components from time to time.

It is a further object of the present invention to provide a game element, and a game employing a plurality of such elements, wherein the user has substantial freedom to compose sound sequences to be emitted by game elements arranged in an array, the sound sequences including music, sound effects, sounds of animate and inanimate nature, sounds associated with man-made devices, or the like.

It is yet another object of the present invention to provide a game element, and a game employing a plurality of such elements, wherein the user has substantial freedom to compose music, even with little or no musical training.

It is yet a further object of the present invention to provide a game element, and a game employing a plurality of such elements, wherein reliance on manual dexterity and memory is minimized.

It is still another object of the present invention to provide a game element, and a game employing a plurality of such elements, which is simple in design, economical to manufacture, durable, and easy and substantially safe to use.

The foregoing and other objects, features and advantages of the invention will be more readily understood upon consideration of the following detailed description of the invention, taken in conjunction with the accompanying drawings.

DETAILED DESCRIPTION

Figure 1:
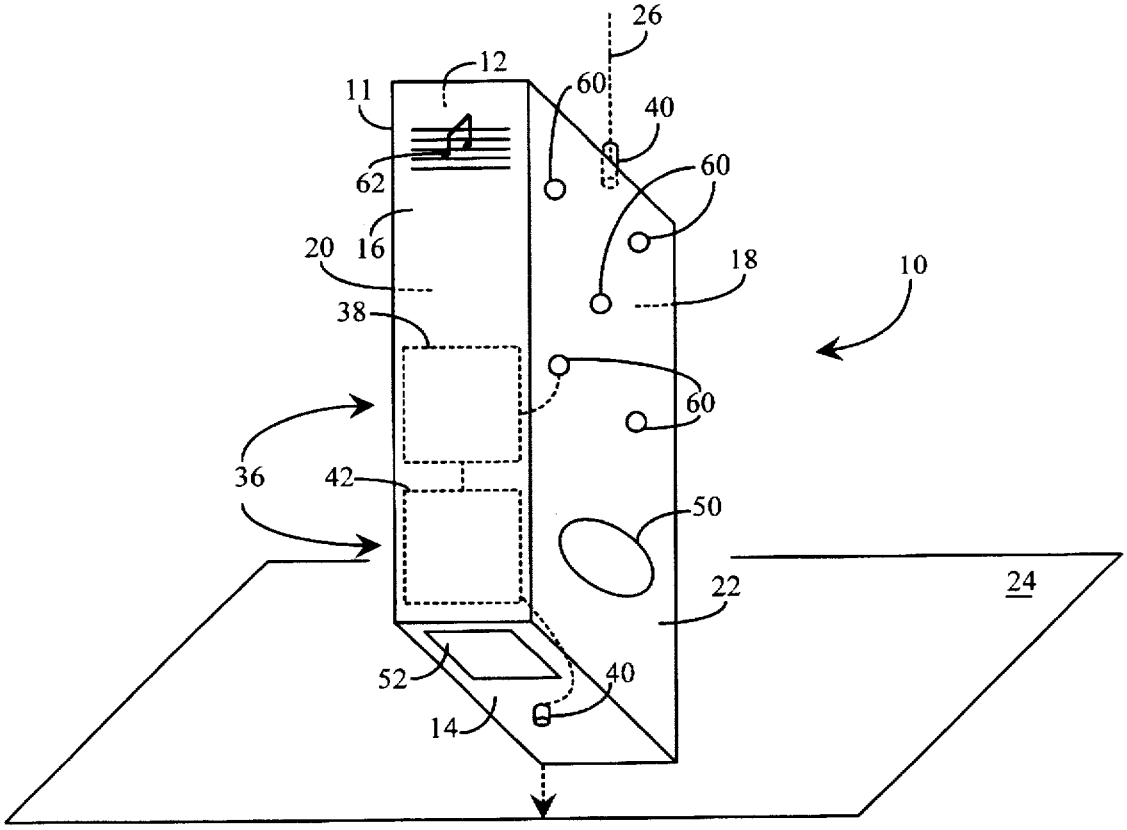
FIG. 1 is a perspective view of a preferred embodiment of a game element according to the present invention, shown positioned uprightly relative to a surface.

Referring to FIG. 1, a game element 10 according to the present invention is shown. The game element 10 preferably has a body 11 including a top side 12, a bottom side 14, a left side 16, a fight side 18, a front side 20 and a back side 22. The game element 10 is positioned so that the bottom side 14 is in contact with a surface 24, the surface 24 being a table top, a floor, a patio, a playground or any other surface suitable for receiving the element. So positioned, the element 10 has a substantially upright orientation relative to the surface 24 and the game element 10 has an upright axis 26. The axis 26 is both substantially perpendicular to the surface 24 and substantially parallel to the longitudes of the left, right, front and back sides 16, 18, 20 and 22. It is to be recognized that the game element 10 can be positioned so that any other side 12, 16, 18, 20 or 22 is in contact with the surface 24. In any such case, the upright axis 26 is yet substantially perpendicular to the surface 24, but is substantially parallel to the longitude of the element's upright sides.

The game element 10, particularly the body 11 as shown, preferably has the shape and dimensions of a standard domino. Moreover, the game element 10 preferably is weighted so as to have the heft of a standard domino. It is to be recognized, however, that the game element 10 can have other shapes, dimensions and weights, without departing from the principles of the invention. For example, the game element 10 can have the shape of a frustum of a cone, an inverted pyramid or other shape. In addition, the game element 10 can be smaller or larger than a standard-sized domino, and have a different weight, weight distribution, or both. In each case, the important point is that the shape, dimensions and weight, including the weight distribution, of the game element 10 are selected so as to enable the element to be placed in one or more upright positions relative to the surface 24. Moreover, the shape, dimensions and weight, including the weight distribution, are selected so that the game element 10 is substantially stable in its upright position and, in particular, so that the element 10 can maintain its upright position without external buttressing or other similar support while, at the same time, being not so stable as to unduly inhibit toppling of the element upon contact with a toppling game element. Any such toppling element can have the same or different shape, dimensions and weight as the toppled element and can itself be toppled by contact with yet another such element, as well as by direct or indirect action of the user.

Figure 2:
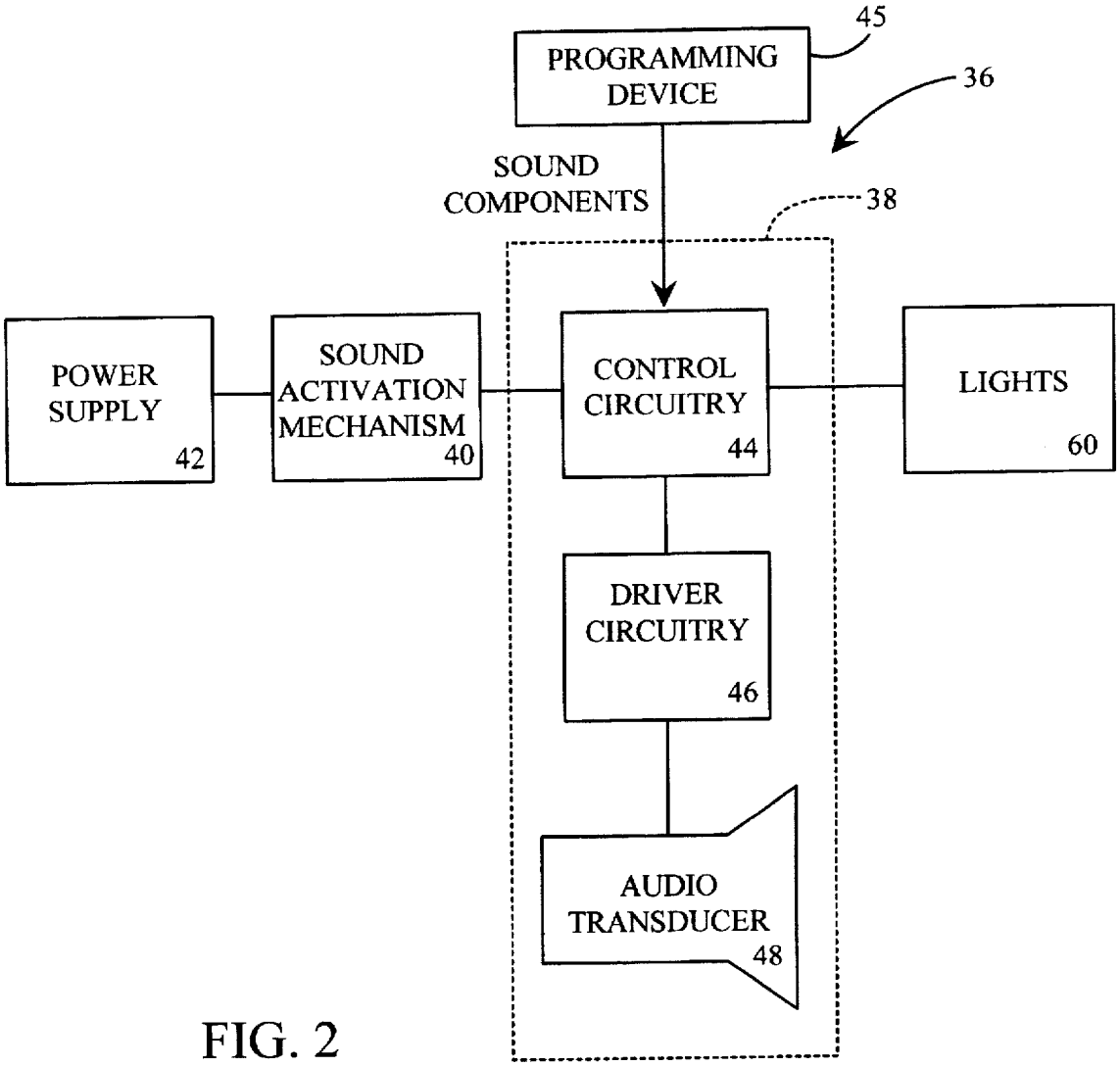
FIG. 2 is a block diagram of an exemplary sound emission assembly for use in the game element of FIG. 1.

Referring now to FIGS. 1 and 2, the game element 10 includes a sound emission assembly 36. The sound emission assembly 36 comprises sound production circuitry 38, a sound actuation mechanism 40 and a power supply 42, each of which individually and in combination are well known in the art. The sound production circuitry 38 provides for producing and emitting one or more sound components specific to a respective game element 10. The sound actuation mechanism 40 enables the sound production circuitry's operation when the game element 10 is toppled.

The sound production circuitry 38 includes control circuitry 44, driver circuitry 46 and an audio transducer 48. The control circuitry 44 is electrically coupled to the driver circuitry 46 which, in turn, is electrically coupled to the audio transducer 48. The control circuitry 44 is also electrically coupled to the sound actuation mechanism 40 which, in turn, is electrically coupled to the power supply 42. The driver circuitry 46 comprises an audio frequency amplifier, while the audio transducer 48 comprises a speaker that can be driven by the amplifier. The control circuitry 44 comprises a digital or analog circuit for controlling the production of the element'sound components, in particular, comprising any circuit, discrete or integrated, capable of generating the one or more audio frequency signals associated with the sound component.

In operation, once enabled by the sound actuation mechanism 40, the control circuitry 44 generates its audio frequency signals for provision to the driver circuitry 46. The driver circuitry 46 amplifies the signals and provides the amplified signals to the audio transducer 48. The audio transducer 48, in receipt of the amplified signals, produces the audible sound component specific to and emitted by the game element 10. The audio transducer 48 operates according to well-known principles associated with speakers.

Although, as described above, a game element 10 produces and emits a specific sound component, it is to be recognized that a game element 10 can be constructed to produce and emit more than one sound component, without departing from the principles of the invention. Sound components comprise one or more tones, or the absence of tones. However, sound components are described not only by the number of tones, but also by the characteristics of each, including the tones's pitch, timbre, intensity, duration and timing (timing being relative to the beginning and ending of the element's toppling). Accordingly, having selectable sound components entails selecting among one or more tones or sequences of tones, or among the same tones or sequences, but altered as to one or more of the above sound Characteristics.

The game element 10 preferably provides for selectably producing and emitting a sound component from among a variety of available sound components by employing user-programmable control circuitry 44, such circuitry being well-known in the art. For example, control circuitry 44 is known that includes a cycling mechanism manipulable by the user to select among sound components in sequence. That is, with each actuation, the control circuitry 44 increments to provide for production of the next sequential sound component. It is also well-known to use control circuitry 44 supporting cycling in a program mode so that, once the desired sound component is reached in the sequence, it can be selected by returning to play mode. It is also well-known to use control circuitry 44 providing a mechanical switch that has several settings, each setting corresponding to a particular sound component. It is also well-known to use, as the control circuitry 44, a microprocessor chip together with an I/O port, the port providing for linking the chip to a programming device 45, such as a personal computer, whereby data associated with the sound component or components to be emitted can be downloaded digitally to the chip. In such case, the chip generally has an associated memory device, such as a static RAM, for storing the downloaded data, as is well-known in the art.

It is also to be recognized that the game elements 10 can be constructed to produce and emit sound components of greater or lesser complexity, without departing from the principles of the invention. Complexity increases, among other ways, by increasing the number of tones to be produced at once, e.g., by seeking to reproduce timbre. Accordingly, the complexity of sound components is increased by employing control circuitry 44 that can produce a complex audio frequency signal, rather than a single tone or series of single tones. In this way, sound components can include whole or partially voiced musical notes, as well as sound effects, sounds of animate and inanimate nature, sounds associated with man-made devices or the like.

The sound production circuitry 38 preferably is disposed substantially within the game element 10. More specifically, the control circuitry 44 and driver circuitry 46 preferably are mounted on a circuit board (not shown) disposed inside the element 10, while the audio transducer 48 can, but need not, be mounted on the circuit board. In any case, the audio transducer 48 preferably is disposed adjacent a port 50 formed in the back side 22 of the game element 10. The port 50 comprises either a single, relatively large aperture or a plurality of relatively small apertures. In each case, the overall dimensions of the port 50 preferably are substantially similar to the dimensions of the active portion of the transducer 48, such that sounds are emitted without substantial attenuation by the element itself. In the former case, the transducer 48 preferably is mounted to fill the port 50, that is, to provide a substantially continuous, smooth surface over the element's back side 22.

It is also to be recognized that the port 50, although shown disposed on the back side 22 toward the bottom side 14, can be otherwise disposed, without departing from the principles of the invention. For example, the port 50 can be disposed on any other side 12, 14, 16, 18 or 20, and can have any relative disposition on the back side 22 or any other side. Subject to other factors, however, the port 50 preferably is disposed to optimize sound emissions. Accordingly, disposition on the back side 22 is preferred when the game element 10 is to topple onto its front side 20.

The power supply 42 preferably comprises one or more batteries (not shown), in particular coin-type batteries. The batteries preferably are replaceable, being inserted and removed through one or more caps 52. The caps 52 preferably seat flush with the respective side or sides 12, 14, 16, 18, 20 and 22 of the game element 10. The caps 52 can slide, pivot, be removable or otherwise open for access to the batteries, while also snapping into place, having fasteners (such as one more screws), locking or otherwise closing off access to the batteries, all as is well-known in the art. The caps 52 can also be provided by having game elements 10 that disassemble, preferably that disassemble into two substantially equal-size pieces for subsequent reassembly and use.

The caps 52 can also provide a terminal for the batteries, as is commonly known in the art. In the alternative, the batteries can be inserted into a receptacle (not shown), providing both battery terminals. For example, the receptacle can be provided on the circuit board.

The sound actuation mechanism 40 preferably comprises a switch that enables the sound production circuitry's production and emission of sound upon the toppling of the game element 10. The sound actuation mechanism 40, as shown, preferably comprises a mechanical switch disposed on the bottom side 14 of the game element 10. The switch is OFF when depressed and ON when extended. In this embodiment, the switch is selected with regard to the element's weight so that, in the event the game element 10 is positioned uprightly with the bottom side 14 on the surface 24, the switch is depressed substantially flush with the bottom side 14. In this way, any instability of the game element 10 associated with the switch is minimized.

Referring to FIG. 2, the switch, in its OFF position, disconnects the control circuitry 44 from the power supply 42. In turn, when the game element 10 topples, the switch extends to its ON position, connecting the control circuitry 44 to the power supply 42 Accordingly, the control circuitry 44 preferably has an associated timer or other mechanism to limit the production and emission of the sound component to once per toppling. The timer preferably also controls if and when the control circuitry 44 begins to generate its audio frequency signals, e.g., in the event a game element 10 is toppled and immediately set upright, the control circuitry 47 can defeat production of its audio frequency signals. The control circuitry 44 also preferably has an associated reset mechanism so that, after an element is toppled and then placed in an upright position, the sound component can be produced and emitted in a subsequent toppling.

Although only one switch is shown, it is to be recognized that more than one switch can be employed without departing from the principles of the invention. For example, a second switch 40 can be disposed on the top side 12 of the game element 10. In that case, the game element 10 can be positioned uprightly either by placing the top side 12 or the bottom side 14 on the surface 24. Each switch 40, then, can enable the sound production circuitry's emission of sound, the emitted sounds being either the same or different.

Figure 4:
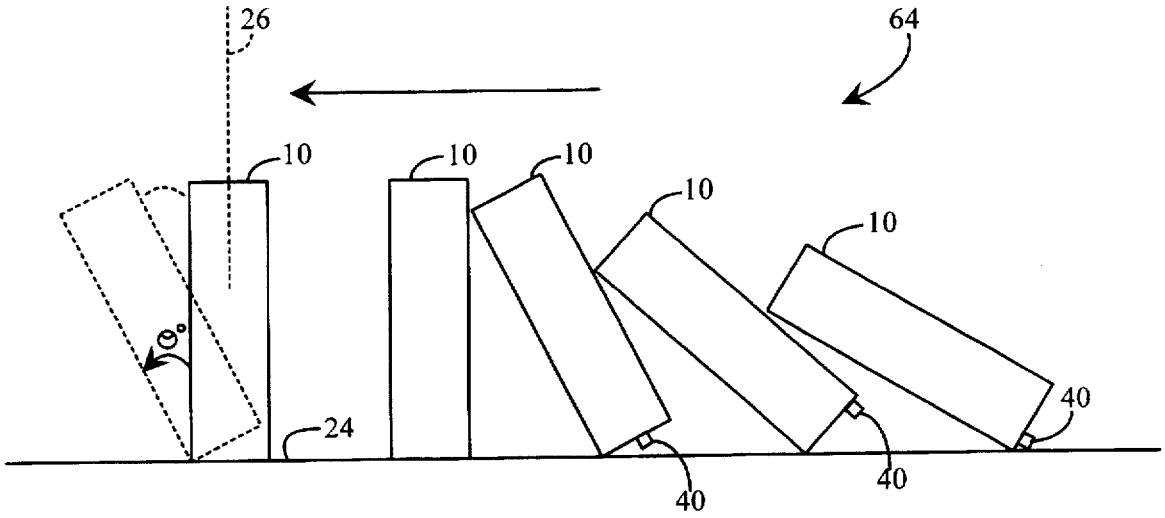
FIG. 4 is a side view of a plurality of game elements arranged in an array according to the present invention, showing cascade toppling of such elements.

It is also to be recognized that, although the switch is shown substantially centered on bottom side 14, the switch can be otherwise disposed without departing from the principles of the invention. For example, the switch can be disposed adjacent either the front side 20 or the back side 22, or anywhere in between. In varying the disposition of the switch, the timing of sound emission is varied. That is, where a game element 10 is toppled toward its front side 20, disposing the switch adjacent the front side 20 enables sound emission to occur later than if the switch is disposed adjacent the back side 22. Moreover, in such case, as the switch is disposed farther from the back side 22 and closer to the front side 20, sound emission occurs progressively later in the element's toppling, as the switch extends at a time progressively later in the toppling. In that regard, as shown in FIG. 4, sound emission can be enabled by the game element 10 being displaced to at least a predetermined angle from the upright axis 26. It is to be recognized that timing of the production and emission of the game element'sound component depends on various factors including, not only the disposition of the switch, but also the type of switch and, in some cases, the design and programing of, or delay components in, the control circuitry.

In selecting the disposition of the switch, however, factors other than timing are to be considered, including whether the switch is able to extend in the event that the element is toppling onto another game element. Accordingly, switch disposition generally provides that the side of the element 10 carrying the pressure switch will pivot off the surface 24 sufficiently to allow the switch to extend, the extension being enabled even though the amount of pivoting may be limited by the element falling onto a subsequent game element.

It is also to be recognized that, although a mechanical switch is shown, the sound actuation mechanism 40 can comprise other types of switches without departing from the principles of the invention. For example, well-known mercury switches can be used. In that case, the switch mechanism can be disposed within the game element 10, preferably being mounted on the circuit board.

As described above, the weight and weight distribution of the game element 10 are selected so as to enable the element to stand stably in an upright position and to topple properly under the appropriate impetus. In that regard, it is preferred that the weight associated with the sound emission assembly 36, particularly that of the batteries, be constrained and distributed so that the game element 10 so stands and topples. It is also to be recognized that the game element 10 can be constructed so as, subsequent to each toppling, to return automatically to the upright position. In that case, sound production and emission preferably is triggered by the game element 10 being displaced to at least a predetermined angle, the angle being relative to the upright axis 26. Moreover, the body 11 in that case preferably has a shape and a weight distribution conducive to attaining such angular displacement under the appropriate impetus, that is, conducive to wobbling, such shapes and weight distributions being well-known in the art.

The game element 10, as shown, also includes one or more lights 60. The lights 60 preferably comprise light emitting diodes (LEDs) that are electrically coupled to the sound emission assembly 36, in particular coupled to and controlled by the control circuitry 44 as is well-known in the art. Lights 60 can have various functions, including an entertainment function, a diagnostic function and an operational function. As to an entertainment function, the lights 60 preferably are multi-colored and are driven coincidentally with the emission of sound so as to add an additional appeal to the user. As to a diagnostic function, the lights 60 can indicate a low battery condition. As to operational functions, the lights 60 can indicate whether the sound emission assembly 36 is reset and, if the sound emission assembly 36 has selectable sound components, can indicate which sound component is then selected.

The game element 10, as shown, also includes marks 62, preferably to identify the sound component or components emitted by the element. The marks 62 can comprise letters (e.g., letters corresponding to musical notes), phonetics (i.e., in teaching exercises), scenes (e.g., scenes of barnyard animals or other animate or inanimate natural sources of sound, or of machinery or other man-made sources of sound), musical notation (e.g., staff, clefs, and scale, note and rest symbols, as well as accidentals, such as sharps and flats, and ornaments, such as trills), or colors.

Figure 3:
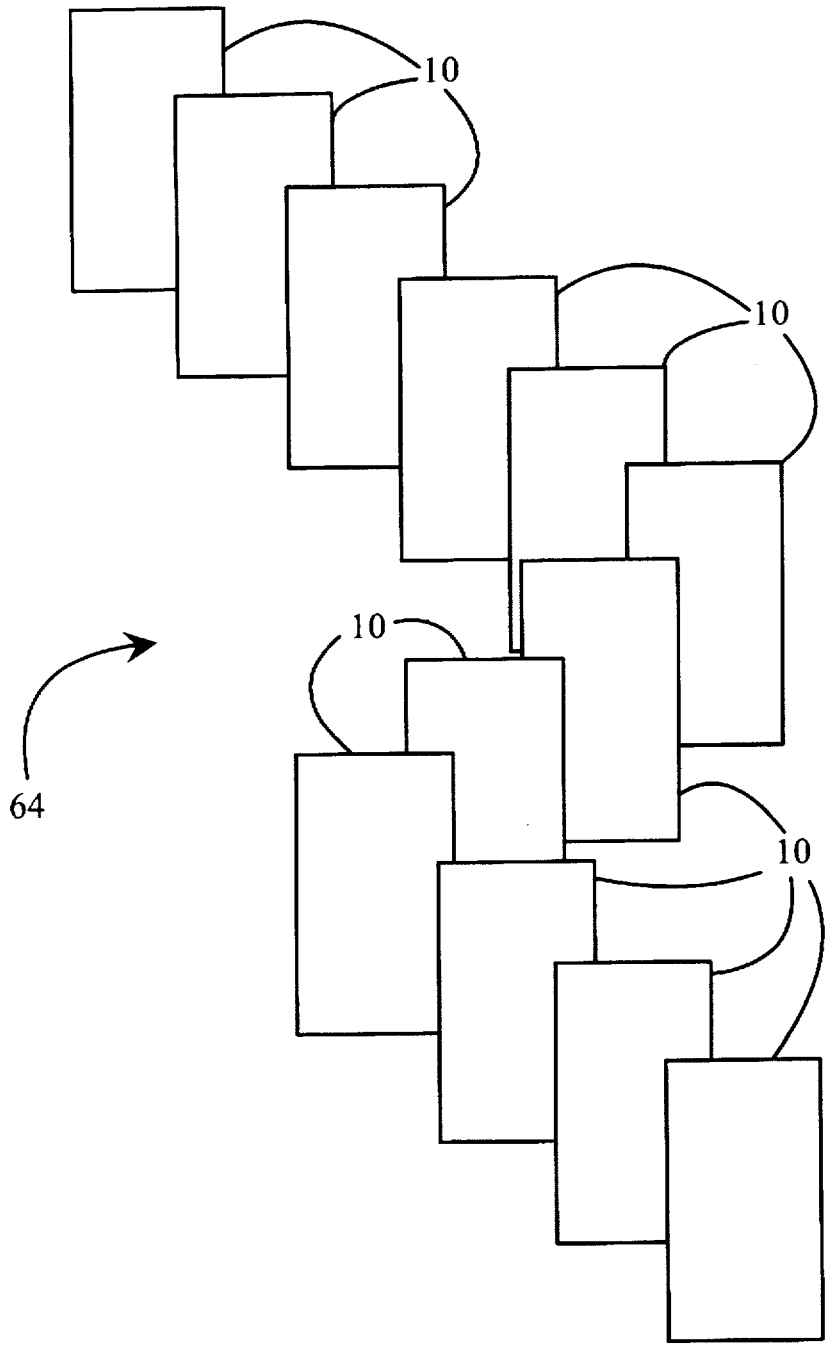
FIG. 3 is a perspective view of a plurality of game elements arranged in an array according to the present invention.

Turning to FIG. 3, a plurality of game elements 10 are shown, arranged in an array 64 according to the present invention. In the array 64, the game elements 10 are placed uprightly, are disposed adjacent one another, and have substantially regular spacing. It is to be recognized, however, that the elements 10 can have other than substantially regular spacing without departing from the principles of the invention. It is also to be recognized that the elements 10 can have shapes and dimensions other than that shown and can have varying shapes and dimensions along the array 64, without departing from the principles of the invention. In both cases, the important point is that, regardless of the spacing, shapes and dimensions of the game elements 10, each element 10 in the array 64, when toppled as illustrated in FIG. 4, makes contact with the next element 10, causing that next element itself to topple, thereby supporting cascade toppling along the array 64.

The user designs and erects the array 64 by selecting the shape of the array 64 and the number of game elements 10 comprising the array 64. In doing so, the user also selects the game elements 10, preferably according to the sound components associated with such elements. That is, the user has substantial freedom to compose the sound sequences to be emitted by toppling along the array 64. That freedom has at least two dimensions. First, the user can compose sound sequences of any complexity by proper selection of the game elements to be deployed along the array 64, the user being cognizant that sound sequences are emitted along the array as the elements 10 are toppled in cascade. Composition freedom follows because each game element 10 emits its sound component independently of all other elements in the array 64. In addition, composition freedom follows because the variety of potential sound components is extremely high, there being a large plurality of audible tones and the tones being both combinable in sequences and being mixable for concurrent emission, while also being adjustable by duration, timing, intensity and other sound characteristics.

Second, the user can compose based on the design of the array itself. Composition freedom follows, particularly in large arrays 64, because the user can arrange the elements 10 in an array 64 so as to generate sound components that comprise one or more separate sound sequences, such as one or more songs. Moreover, the user can erect an array 64 so that more than one line of game elements 10 topple in cascade at any one time. In that case, the lines can have respective sound sequences emitted concurrently along the array, in which case the sound sequences can be made to appear to overlap spatially as the array's lines intersect or run parallel to one another.

To assist the user in designing and erecting arrays that emit sound by employing a plurality of game elements 10, an instruction booklet (not shown) preferably is used. The booklet can have various functions, including (i) to describe each sound element 10 according to its sound components or components and the marks 66 which identify the elements; (ii) to explain the function of lights 60, if any; (iii) to explain, if applicable, how to program the elements 10; (iv) to explain how to adjust the timing of sound components in a sound sequence by, if applicable, proper orientation of the switch of the sound actuation mechanism 40; (v) to suggest designs for the array 64; and (vi) to suggest sound sequences including the game elements 10 and array designs necessary to achieve the sound sequences. It is also to be understood that a template can be used in constructing the array without departing from the principles of the invention.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A game element for disposition on a surface by a user, comprising:

a body, said body being disposed in contact with the surface in an upright position relative to the surface; and a sound emission assembly incorporated in said body, said assembly emitting a sound component directly from said body when said body moves from said upright position in a predetermined displacement, said sound emission assembly including sound production circuitry and a sound actuation mechanism, said sound production circuitry producing and emitting said sound component and said sound actuation mechanism sensing said movement of said body and, in response thereto, enabling said sound production circuitry, said body including a side, and said body is uprightly disposed by placing said side in contact with the surface, and said sound actuation mechanism comprises a mechanical switch disposed on said side, said mechanical switch being depressed when said body is upright and extending when said body is moved from said upright position in said predetermined displacement, such that said extension of said switch enables said sound production circuitry.

2. The game element of claim 1, wherein said disposition of said mechanical switch is selectable on said side.

3. A game for play by a user on a surface, comprising a plurality of game elements having respective sound components, said game elements being disposed uprightly to form an array and, when toppled in cascade, emitting said respective sound components sequentially along the array to generate one or more sound sequences, a plurality of said game elements including lights and said lighted game elements are selectively placed in said array so as to produce a selected light sequence.

* * * * *